United States Patent [19]

Kapoor

[11] Patent Number: 4,776,576

[45] Date of Patent: Oct. 11, 1988

[54] KICKDOWN APPARATUS AND METHOD OF KICKDOWN

[76] Inventor: Vinod Kapoor, #3 Jordan Road, Hastings-on-Hudson, N.Y. 10706

[21] Appl. No.: 27,318

[22] Filed: Mar. 18, 1987

[51] Int. Cl.[4] ..... B65H 29/68

[52] U.S. Cl. ..... 271/182; 198/462; 101/232; 271/202

[58] Field of Search ..... 271/182, 202, 306, 308, 271/270, 189, 151, 69; 198/462; 101/232

[56] References Cited

U.S. PATENT DOCUMENTS 3,507,489 4/1970 Wilshin et al. ..... 271/182
3,994,221 11/1976 Littleton ..... 271/202

FOREIGN PATENT DOCUMENTS 1158844 7/1969 United Kingdom ..... 271/182

*Primary Examiner*—H. Grant Skaggs

[57] ABSTRACT

A method and apparatus for snubbing or kicking down the trailing end portions of cut web portions of paper as such cut web portions are discharged from a first conveyor to a second conveyor traveling at a slower conveying speed than the first conveyor. Specifically, the appartus for such snubbing or kick down has no velocity component in the direction of travel of the cut web portions at the moment of contact and essentially no such velocity component during a period of engagement. By eliminating such velocity component an improved handling of the cut web portions is obtained. From an appartus concept a framework is rotated in synchronism with the apparatus for cutting a traveling paper web and such framework supports an independently rotatable snubber or kick down apparatus.

20 Claims, 3 Drawing Sheets

KICKDOWN APPARATUS AND METHOD OF KICKDOWN

BACKGROUND OF THE INVENTION

This invention relates to an apparatus for engaging the trailing edges of seriatim or sequentially discharged sheets of paper previously cut from a traveling web of paper to sequentially decelerate the cut sheets and lower the trailing edges thereof. By lowering a trailing edge, the leading edge of the next oncoming sheet freely travels over and overlaps the lowered trailing edge. The cut sheets are decelerated by sequentially pressing the trailing edges into engagement with the conveying run of a conveyor traveling at a relatively slower speed so that the sheets travel at essentially the same speed as the conveying run. The structure of this invention also contacts each sequential sheet such that at the moment of contact the sheet engaging member does not have any movement in the direction in which the sheet is traveling.

In the printing industry it is well known to utilize sheeters to receive a traveling web of printed paper as such web is discharged from the final printing rollers of the press. Such sheeters cut the traveling web into finished length printed products and then discharge the cut sheets successively or sequentially onto the first of a pair of elongated conveyors arranged in series. The first conveyor travels at a speed slightly faster than the speed at which the cut sheets are discharged from the cutting device such that the successive cut sheets are spaced from each other on the first conveyor in the direction of travel of the first conveyor. The second conveyor travels at a slower speed, with respect to the first conveyor, to receive the successive sheets in lengthwise overlapping relationship. Such overlapping relationship is commonly referred to as a shingled relationship. Such shingled sheets are sequentially discharged from the second conveyor to a sheet stacking platform in a well known manner and are removed as desired in a well known manner. In order to handle successive sheets with respect to the speed of the web traveling through the printing press the first and second conveyors are orbital conveyors having elongated conveying runs with the slower speed second conveyor traveling at about 10 to 15% of the web speed. Under such conditions the discharge of sheets onto the second conveyor creates various problems in shingling of the individual sheets. One problem in shingling such sheets is the necessity to either kickdown the trailing edge of each successive sheet or to kickdown and snub the forward travel of each successive sheet so that each sheet will travel at essentially the speed of the slower second conveyor.

U.S. Pat. No. 3,994,221 shows a rotary arm (or kickdown arm) with a wheel for engaging the trailing edge of each successive sheet; however, such rotary arm has a substantial velocity component in the direction of travel of the second conveyor such that the arm is not very effective at high press speeds to snub the travel of each sheet so that the sheets will travel with the second conveyor.

BRIEF DESCRIPTION OF THE INVENTION

In the instant invention one or more rotary knockdown or kickdown arms are provided each of which has a brush wheel at its lower end which wheel has a zero velocity in the direction of travel of a paper sheet at the instant or moment the paper sheet is initially engaged or contacted. Further, after such initial engagement each arm has, at best, only a small relative velocity with respect to the paper sheet in the direction of travel of the engaged sheet. More specifically, the kickdown arm of this invention comprises a rotary frame which carries at least one offset elongated rotary shaft to which one or more elongated arms are secured. Each arm has a brush wheel at its outer end which wheel is free to rotate and travels in a lateral path with respect to the direction of travel of sheets as they travel through a sheeter.

Accordingly, one object of this invention is to provide a new and improved elongated kickdown arm structure for a sheeter in which the free end of the arm structure does not have a forward velocity in the direction of travel of the sheet at the moment the sheet is contacted by the arm structure.

Another object of this invention is to provide a new and improved elongated kickdown arm structure for a sheeter in which one end of the arm structure is supported for rotation by a shaft which shaft is rotatively carried by a rotary framework such that the arm structure travels in a circular orbit about the central axis of rotation of the framework.

Still another object of this invention is to provide a new and improved elongated kickdown arm for a sheeter in which a free end of the arm travels in a straight path transversely of the direction of travel of the paper sheets to be kicked down.

A specific object of this invention is to provide a new and improved elongated kickdown arm for a sheeter in which a free end of the arm reciprocates through a linear path.

A further specific object of this invention is to provide a new and improved elongated kickdown arm structure for a sheeter in which one end of the arm is supported by a rotatable shaft carried by a rotating framework which shaft rotates on an axis offset from the rotation axis of the framework such that the free end of the arm structure has no movement in the direction of travel of an engaged sheet at the moment of contact.

Another object of this invention is to provide a new and improved kickdown arm structure for a sheeter in which the force applied to a traveling sheet can be varied.

These and other objects of this invention will become more apparent upon consideration of the following detailed description and illustrations of the presently preferred embodiment thereof, in which.

DESCRIPTION OF THE PRESENTLY PREFERRED EMBODIMENT

Figure 1:
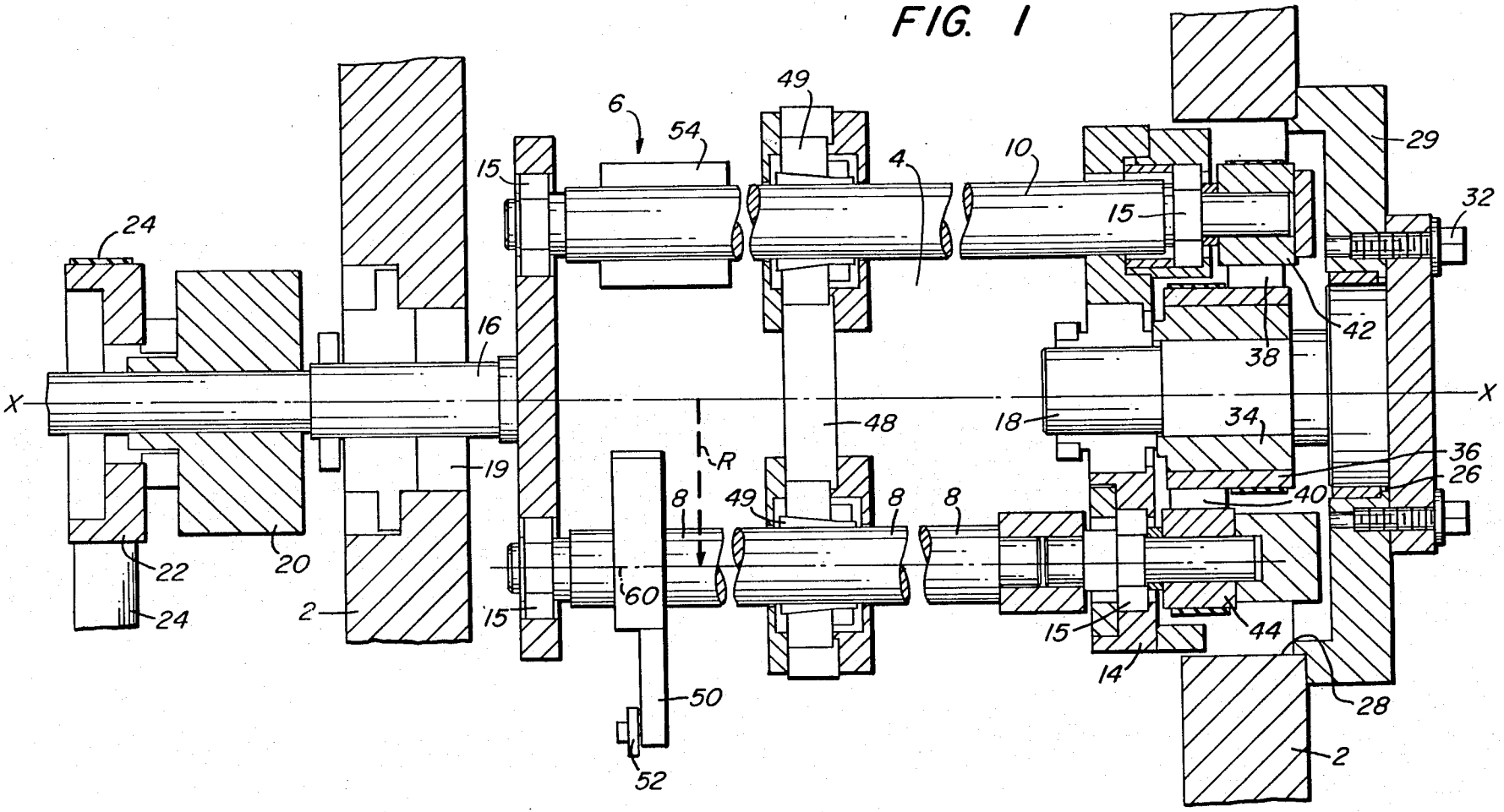
FIG. 1 is a cross sectional view of a kickdown structure constructed in accordance with the principles of this invention with portions thereof being shown in elevation.

U.S. Pat. No. 3,994,221 discloses and illustrates a typical prior art structure of a sheeter and such structure is incorporated herein for a better understanding of this invention. As shown, a known sheeter comprises a formed rigid frame having laterally spaced elongated side frame members 2 which are suitably rigidly secured together to form an elongated space 4 therebetween. As is customary the individual sheets of printed material travel forwardly between frame members 2 to a sheet receiving platform (not shown). A kickdown assembly or unit 6 extends transversely between frame members 2 and is rotatively supported thereby for rotation about its central rotation axis x—x.

Unit 6 comprises a pair of elongated shafts 8, 10 the ends of which are suitably rotatively supported in spaced end members or plates 12, 14 by suitable bearings 15 suitably carried by plates 12, 14. The central rotative axes of shafts 8, 10 are parallel to each other and parallel to the axis x—x and are diametrically opposed from each other with respect to the axis x—x. Plate 12 is located inwardly adjacent the left frame members 2 (with respect to FIG. 1) while the plate 14 is located inwardly adjacent the right frame member 2. The right frame member 2 has an opening 28 therein through which a portion of plate 14 extends inwardly adjacent the periphery of opening 28. Shafts 8, 10 extend transversely between frame members 2. Supporting shafts 16, 18 extend transversely with respect to plates 12, 14 and are of a structure whereby the central rotative axis x—x of unit 6 extends through the longitudinal central axis of shafts 16, 18.

Shaft 16 is the power input side for rotating unit 6. For such purposes shaft 16 is suitably rotatably supported by a bearing means 19 suitably carried by the left frame member 2 and extends laterally outwardly of the left frame member 2 to receive a suitable overload clutch 20 and drive pulley 22 as are well known in the printing press art. Pulley 22 is an externally toothed member which is driven by a suitable internally toothed timing belt 24 whereby the rotating pulley 22 drive the clutch 20 which is keyed to the shaft 16 to rotate shaft 16. Shaft 16 is rigidly secured to plate 12 such that rotation of shaft 16 rotates the kickdown unit 6 about axis x—x. Timing belt 24 is driven in any suitable manner from the sheeter drive as is known such that the rotation of unit 6 is synchronized with the travel of the cut web sheets through the sheeter. The toothed engagement of belt 24 and pulley 22 insure the proper timed rotation of pulley 22 and consequently shaft 16 and unit 6. Rotation of unit 6 is in synchronism with the web cutters of the sheeter as is known, such that unit 6 rotates in a 1 to 1 ratio with respect to the cutting action of the cutter of the sheeter. See the U.S. Pat. No. 3,994,221 for a further description of such 1 to 1 ratio. The terms left, right, upper and lower as used herein are within reference to FIG. 1 and are for the purpose of simplifying the description of the structure of this invention and are not limiting as to the structure of this invention.

The right portion of unit 6 is rotatively supported by the stationary shaft 18, through a suitable bearing, and is provided with a structure to rotate shafts 8, 10 relative to end plates 12, 14 during the period unit 6 rotates. The right end of unit 6 extends through the central opening 28 and is supported for rotation by a suitable bearing carried on the inner end of shaft 18 and plate 14. Opening 28 is enclosed by an outer stationary member 29 suitably rigidly secured to the right frame member 2. Member 29 has a central opening 26 therein which is enclosed by an overlaying outer cover 30. Cover 30 is suitably releasably secured to the member 29 by means of a suitable plurality of bolts 32 whereby plate 30 can be selectively loosened and rotated about the axis x—x. Cover plate 30 suitably rigily carries shaft 18 and shaft 18 extends from plate 30 through openings 26 and 28 and inwardly between or intermediate the right end portions of shafts 8, 10. The central axis of shaft 18 is coincident with axis x—x; however, shaft 18 remains stationary at all times and end plate 14 rotates about shaft 18. End plate 14 is located inwardly adjacent the right frame member 2 while the ends of shafts 8, 10 rotate within the opening 28.

Shaft 18 suitably carries a stationary timing pulley 34 having external teeth 36 which teeth 36 extend longitudinally of the central longitudinal axis of shaft 18 to provide a suitable tooth length for receiving portions of a pair of side by side internally toothed timing belts 38, 40. As shown, the right end of shaft 8 carries a timing pulley 44 for conjoint rotation therewith which pulley 44 is located outwardly of bearing 15 and has external teeth thereon for receiving the toothed timing belt 40. Pulley 44 is fixed with respect to the central rotative axis of shaft 8 to rotate simultaneously with shaft 8. Timing belt 40 is an internally toothed member with the teeth thereof being of a configuration to engage the external teeth 36 of the stationary toothed pulley 34 and the external teeth on the timing pulley 44.

Figure 3:
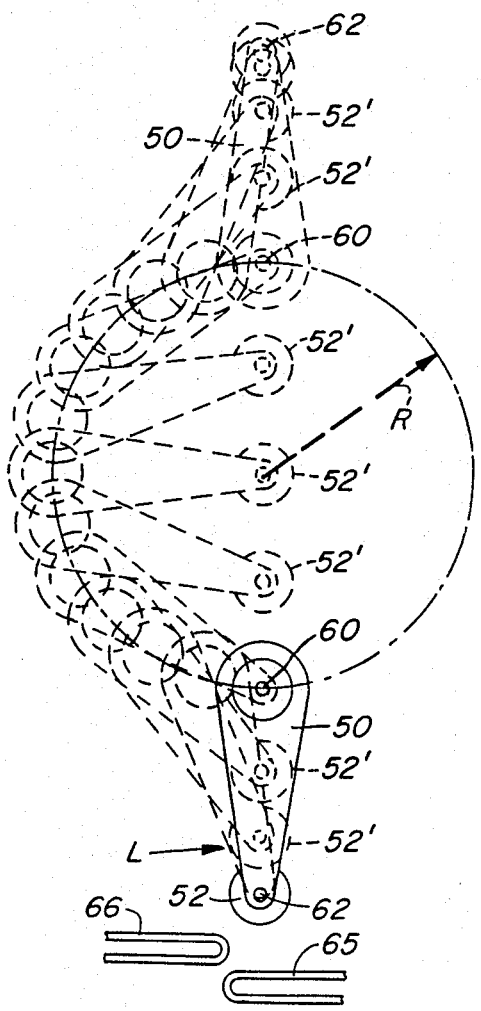
FIG. 3 is a diagrammatic representation of the movement of the kickdown arm as shown in FIG. 1 and the conveying runs of first and second conveyors cooperable therewith.
Figure 4:
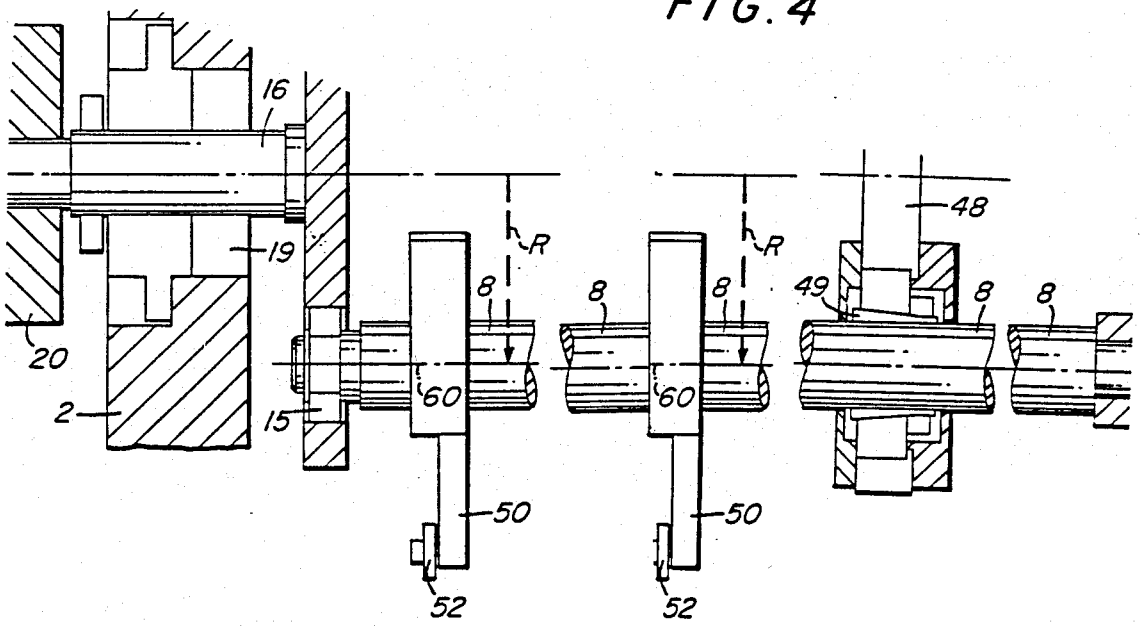
FIG. 4 is a cross sectional view of a second embodiment showing a plurality of arms carried by an elongated shaft and in accordance with the principles of this invention with portions thereof being shown in elevation.

With such structure the rotation of unit 6 by the power input belt 24 will cause shaft 8 to bodily rotate about axis x—x such that the teeth on pulley 44 engaging the teeth on belt 40 will simultaneously cause the shaft 8 to rotate with respect to end plates 12, 14. Thus, shaft 8 has simultaneously dual rotation about its own longitudinal central rotative axis and the axis x—x. Shaft 10 similarly carries a rigidly mounted externally toothed pulley 42 outwardly of the bearing 15 on the right end of shaft 10. Pulley 42 is in lateral alignment with the outer portion of the teeth 36 of pulley 34. Belt 38 encompasses pulley 34 and pulley 42 and has internal teeth cooperable therewith such that as end plate 14 rotates the shaft 10 is rotated in timed relationship therewith. Thus, shaft 10 has, in the same manner as shaft 8, simultaneous dual rotation. The number of teeth on pulley 34 is twice the number of teeth on pulleys 42, 44; therefore, the rotation of unit 6, as described, causes the shafts 8, 10 to rotate about their own longitudinal central rotation axes at twice the rate (revolutions per minute) unit 6 rotates about axis x—x. In addition, the direction of rotation of shafts 8, 10 is opposite the direction of rotation of unit 6 as shown in FIG. 3.

Figure 2:
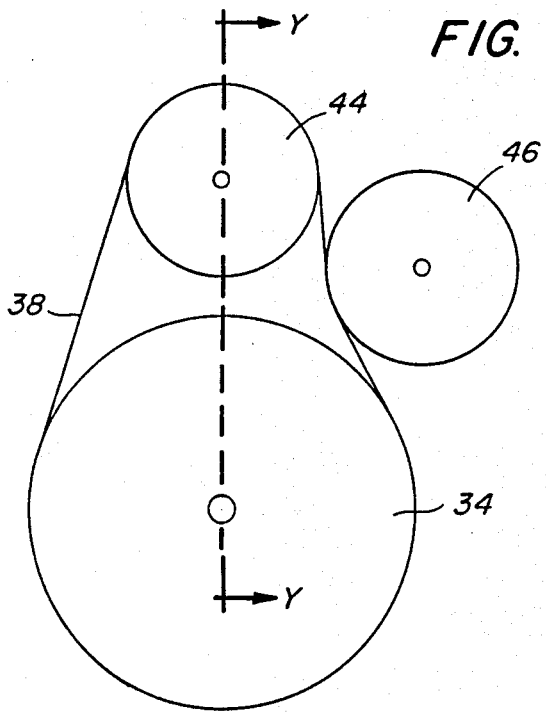
FIG. 2 is an end view of a timing belt and pulley for the structure as shown in FIG. 1.

FIG. 2 illustrates the use of a suitable supported offset rotatable pulley 46 for properly tensioning the timing belts, illustratively belt 38. The rotative position of pulley 46 is adjustable as is known to provide proper tension for the belt 38. A similar tensioning structure is provided for the belt 40.

Preferably the central portions of shafts 8, 10 are supported to reduce the stresses therein by an elongated central support 48. Support 48 extends transversely between shafts 8, 10 with the outer ends thereof encompassing shafts 8, 10, respectively. Suitable bearing means 49 are carried by the encompassing ends of support 48 whereby shafts 8, 10 are rotatable with respect to support 48. Shaft 8 also carries an elongated kickdown arm 50, which is suitably rigid secured to shaft 8, such as being keyed thereto, whereby shaft 8 and arm 50 rotate together. Arm 50 extends laterally outwardly of shaft 8 with the outer end of arm 50 carrying a known type rotatable brush wheel 52. Although only one arm 50 is shown, as many arms 50 as desired may be secured to shaft 8. Typically shaft 8 will carry 6 or 8 kickdown arms to engage laterally spaced portions of the trailing edge of a traveling cut web of paper. One or more counterweights 54 are carried by shaft 10 in laterally opposite relationship to arm 50 to permit high speed balanced rotation of unit 6. If desired, counterweight 54 can be replaced by another arm 50 and wheel 52 to provide a second kickdown mechanism. Arm 50 on shaft 8 is shown in FIG. 1 in the down position so that, in the event shaft 10 also carries an arm 50 and wheel 52, such second arm 50 will extend upwardly from shaft 10 and opposite the arm 50 on shaft 8.

In operation the power input belt 24 rotatably drives shaft 18, end plates 12, 14 about axis x—x. Shafts 8, 10 and pulleys 42, 44 bodily rotate about the central axis of the stationary pulley 34 (i.e., axis x—x). Consequently an axis y—y extending through the centers of pulley 44 and pulley 34 (see FIG. 2) represents, since belt 40 is tensioned, a force vector between pulley 44 and pulley 34 such that as the center of pulley 44 bodily rotates, the position of belt 40 relative to the teeth on pulley 34 varies. That is, the belt 40 bodily rotates with reference to the center of pulley 34. Such bodily rotation of belt 40 causes the external teeth of pulley 44 to engage the internal teeth of belt 40 and, as the number of teeth on pulley 34 is twice that on pulley 44, the shaft 8 is rotated at twice the rpm of the unit 6. The combined rotation of arm 50 in unison with unit 6 and the separate simultaneous rotation of arm 50 in unison with shaft 8 causes a combined motion of arm 50 as shown in FIG. 3. Although, as described, the arm 50 has a wheel 52 at the outer end thereof, the arm 50 with wheel 52 attached is properly identified as an arm or an arm structure. A similar y—y axis extending through the centers of pulley 42 and pulley 34 (not shown) will rotate laterally about the axis x—x due to the rotation of unit 6.

As shown, a center 60 of arm 50 is coincident with the central rotational axis of shaft 8 and rotationally travels about the axis x—x in a circle having a radius R which is the radical distance between the axis x—x and center 60. In FIG. 3 center 60 of arm 50 is shown as rotating counter-clockwise about axis x—x. With such geometry and rotation a center 62 of wheel 52 travels from a upper position in a straight line transversely through axis x—x to an lower position L (shown in dash line). As the center 60 of arm 50 continues to rotate counter-clockwise from the lower position L to the upper position the center 62 of wheel 52 again travels in a straight vertical line laterally through the axis x—x to the upper position. Thus, the movement of center 62 consists of repeated straight line movement in opposite directions depending upon the direction of movement of the center 60—i.e., upwardly or downwardly. Thus, center 62 reciprocates in a vertical line. In both the upper position and the lower position L the center 62 is located the distance R outwardly of the locus of the rotation of center 60. The vertical travel of the center 62 is shown by the various intermediate positions of wheel 52 shown as 52'.

FIG. 3 illustrates the movement of arm 50 and brush wheel 52 as unit 6 rotates. The motion of arm 50 results from the dual rotation of shaft 8 as previously described. As shown, center 60 rotates counter-clockwise about axis x—x at the radius R from the uppermost position of arm 50 shown broken lines. Simultaneously the arm 50 rotates about the center 60 in a clockwise manner at twice the rate (rpm) of rotation of unit 6. The resultant motion is shown wherein the center 62 moves in a straight line from the upper position to the lower position L. Center 62 moves through the axis x—x and for such movement the distance between the centers 60 and 62 is equal to the radius R. Although, as shown, 62 moves in a vertical path, if desired, a non-vertical straight path can be obtained by adjusting the position of pulley 34 with respect to the axis x—x.

With the structure described the wheel 52 travels sequentially upwardly and downwardly in a straight line since the rotation axis of wheel 52 is on center 62. Since the radius R is known, the location of the outer periphery of wheel 52 for a given wheel 52 is known. Accordingly, the outer periphery of wheel 52 is selected to engage a traveling cut web of paper to urge such engaged cut web towards or into engagement with the tapes of a lower conveyor 65. As is shown, see the before referenced patent, such cut web is discharged at a relatively high speed from an initial conveyor 66 onto a slower traveling conveyor 65 which is located at a slightly lower level with respect to conveyor 66. As is known, the tapes of conveyor 65 may travel at 10 to 15% of the speed of the cut webs as discharged from conveyor 66. While the cut web is traveling in the air after discharge from conveyor 66 the wheel 52 is timed to engage the trailing edge or end of the cut web and urge the cut web into engagement with the upper conveying run of conveyor 65. Normally such upper conveying run comprises elongated laterally spaced tapes. By urging the trailing end of the cut web into engagement with the conveying run of conveyor 65 the cut web will be slowed to essentially the speed of the conveying run of conveyor 65. If desired, conveyor 65 can be repositioned so that the portion of the conveying run thereof below wheel 52 is lowered so that wheel 52 only kicks down the trailing end of a cut web without causing engagement of the cut web with the conveying run of conveyor 65. In such event the wheel 52 functions only as a kickdown arm and no snubbing of the web on the tapes of conveyor 65 occurs. Further, such lowering of the receiving end of conveyor 65 permits the handling of various thicknesses of cut and/or folded sheets.

Since wheel 52 travels in an upward and downward direction, there is no velocity component of wheel 52 in the plane through which the cut web is traveling (i.e., transversely to the vertical path of movement of wheel 52) at the time the cut web is engaged or contacted by wheel 52. Such relative vertical movement only at the moment of contact permits high speed operation. In addition, since the wheel 52 does not travel horizontally over the cut web, no smearing of the cut web will occur.

As indicated, counterweight 54 can be removed and an additional arm 50 attached to the shaft 10 in vertical alignment with arm 50 on shaft 8. Such additional arm 50 is utilized when a cut web is half the length of the cut web for which the arm 50 on shaft 8 is designed. By releasing cover 30 from member 29, cover 30 with shaft 18 can be rotated about axis x—x. Cover 30 is provided with arcuate slots through which the bodies of bolts 32 extend. After wheel 52 contacts the trailing end of a traveling web the wheel 52 will remain in engagement with the cut web. After the cut web is received upon the conveying tapes of conveyor 65 with the wheel 52 in engagement therewith the wheel 52 will rotate due to the horizontal movement of the web on conveyor 65 during the period of engagement of the wheel 52 on the cut web on the conveyor tapes. Such period of engagement will be small due to the rapid upward movement of wheel 52 after engagement with a cut web.

For additional description of the structure of this invention the Model S1800 Sheeter bulletin of Blava In-Line, Inc. is incorporated herein and a copy thereof is enclosed with this application. This bulletin was published on or about September 1986.

Having described a preferred embodiment of this invention in accordance with the Patent Statutes, those skilled in the relevant art will be cognizant of the fact that modifications can be made to the described structure without departing from the spirit and scope of this invention. For example, a gear drive may be utilized in place of the timing pulleys and belts described. Accordingly, the following claims are to be construed as including modifications of the structures defined herein as would be known to those skilled in the relevant art.

I claim:

1. The method of controlling the movement of respective traveling cut webs of paper discharged in seriatim from a first horizontally moving conveyor onto a second horizontally moving conveyor which second conveyor travels at a lower conveying speed than the first conveyor comprising:

sequentially contacting a trailing end portion of each said seriatim discharged web by a free end of an elongated arm which free end reciprocates through an essentially vertical linear path while the other end of said arm rotates in conjunction with a rotating shaft carried by a rotating member which rotating member has an axis of rotation parallel to the axis of rotation of said shaft, and moving said sequentially contacted trailing end portions towards said second conveyor during the movement of said free end through at least a lowermost portion of the downward vertical movement thereof.

2. The method of claim 1 wherein said contacting is in synchronism with a mechanism for producing such cut webs.

3. The method of claim 1 wherein said contacting is maintained until such trailing end portions engage the conveying portions of such second conveyor.

4. The method of claim 1 wherein said contacting is maintained for a period of time to press such trailing end portions into engagement with said second conveyor.

5. The method of claim 4 wherein each said seriatim discharged web is engaged by a plurality of free ends of identical elongated arms.

6. A snubber for traveling paper webs comprising:

a framework member structure adapted to be rotatively supported in printing equipment for rotation about a first axis in synchronism with the operating speed of such printing equipment, an elongated shaft rotatively supported by said framework member for rotating about a second axis spaced laterally of said first axis, an arm structure carried by said shaft for rotation therewith and extending laterally outward from said second axis, and drive means cooperable with said shaft to rotate said shaft at a higher rotational speed than said framework member rotates to reciprocate the outer end of said arm structure through an essentially linear path.

7. A snubber as set forth in claim 6 wherein said linear path is a vertical path.

8. A snubber as set forth in claim 6 wherein said first and second axes are parallel.

9. A snubber as set forth in claim 6 wherein said shaft rotates at twice the speed of said framework member.

10. A snubber as set forth in claim 6 wherein a plurality of arm members the same as said first mentioned arm member are carried by said shaft in axial alignment with each other.

11. A snubber as set forth in claim 6 wherein a second elongated shaft is rotatively supported by said framework member for rotation about a third axis spaced laterally of said first and second axis, counterbalancing means carried by said second shaft for counterbalancing said arm structure, and drive means cooperable with said second shaft to rotate said second shaft at the same rotational speed that said first mentioned shaft rotates.

12. A snubber as set forth in claim 6 wherein a second elongated shaft is rotatively supported by said framework member for rotation about a third axis spaced laterally of said first and second axis, other arm structures carried by said second shaft to function in the same manner as said first mentioned arm structure, and drive means cooperable with said second shaft to rotate said second shaft at the same rotational speed that said first mentioned shaft rotates.

13. A snubber for traveling paper webs comprising:

a stationary frame, a first conveyor supported by said frame for discharging identical sheets of paper in seriatim therefrom, an elongated conveyor supported by said frame for receiving said discharged sheets, said second conveyor having a lower conveying speed than said first conveyor, a formed framework member carried by said frame for rotation about a first axis, said framework member being located upwardly adjacent the end of said second conveyor which receives said discharged sheets, a shaft member rotatively supported by said framework member for rotation about a second axis spaced parallel to the rotation axis of said framework member, an arm structure carried by said shaft member for conjoint rotation therewith, said arm structure extending laterally of said second axis and outwardly of said shaft member, said formed member being adapted to be rotated in synchronism with the operation of a printing press for printing paper webs, drive means cooperable with said shaft member for rotating said shaft member at a rotative speed higher than the speed at which said framework member rotates to move the outer end of said arm structure through an essentially linear path.

14. A snubber as set forth in claim 13 wherein said shaft member rotates at twice the speed of said framework member.

15. A snubber as set forth in claim 13 wherein a second shaft member is rotatively supported by said framework member and additional drive means cooperable with said second shaft member drive said second shaft at the same speed as said first mentioned shaft member is driven.

16. A snubber as set forth in claim 15 wherein said second shaft member carries a counterbalance to counterbalance said arm structure.

17. A snubber as set forth in claim 15 wherein an arm structure is carried by said shaft second member.

18. A snubber as set forth in claim 15 wherein a plurality of arm structures are carried by each of said shaft members, respectively.

19. A snubber as set forth in claim 13 wherein said member is an elongated shaft member and a plurality of arm structures are carried thereby.

20. A snubber as set forth in claim 13 wherein said framework member rotates at half the speed as said shaft members.

* * * * *